US006807385B2

(12) United States Patent
Miyake et al.

(10) Patent No.: US 6,807,385 B2
(45) Date of Patent: Oct. 19, 2004

(54) DIFFERENCE POTENTIAL PREVENTING IMAGE FORMING APPARATUS

(75) Inventors: Koji Miyake, Iwatsuki (JP); Masaki Suto, Iwatsuki (JP); Hiroyuki Mitsu, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/369,580

(22) Filed: Feb. 21, 2003

(65) Prior Publication Data

US 2003/0231892 A1 Dec. 18, 2003

(30) Foreign Application Priority Data

Jun. 14, 2002 (JP) ..... 2002-174831

(51) Int. Cl.[7] ..... G03G 21/00; G03G 15/16

(52) U.S. Cl. ..... 399/66; 399/71; 399/101; 399/302

(58) Field of Search ..... 399/71, 101, 66, 399/43, 302, 308, 314, 343, 349; 15/256.5, 256.51, 256.52

(56) References Cited

U.S. PATENT DOCUMENTS 5,991,566 A * 11/1999 Tanaka et al. ..... 399/101
6,049,681 A * 4/2000 Shiozawa et al. ..... 399/101 X
6,240,271 B1 * 5/2001 Shimazawa et al. .... 399/302 X
6,308,019 B1 * 10/2001 Miyashiro et al. ..... 399/66
6,405,002 B2 * 6/2002 Ogiyama et al. ..... 399/101
2003/0118379 A1 * 6/2003 Hattori ..... 399/302 X
2003/0219275 A1 * 11/2003 Mitsu et al. ..... 399/101

FOREIGN PATENT DOCUMENTS

| | | |
|---|---|---|
| JP | A 6-35340 | 2/1994 |
| JP | A 6-59586 | 3/1994 |
| JP | 2000-003117 | * 1/2000 |
| JP | A 2001-142310 | 5/2001 |
| JP | 2001-282007 | * 10/2001 |
| JP | 2002-372876 | * 12/2002 |

* cited by examiner

*Primary Examiner*—Sophia S. Chen
(74) *Attorney, Agent, or Firm*—Oliff & Berridge, PLC

(57) ABSTRACT

An image forming apparatus capable of preventing generation of an excessive difference in potential between a cleaning member and an intermediate transfer member to thereby increase the service life of the intermediate transfer member, including an image bearing member; an image forming unit; an intermediate transfer device formed by at least one intermediate transfer member; a final transfer member; a cleaning member; and a control unit which applies an intermediate-transfer-member-bias to the intermediate transfer member and applies a cleaning-member-bias to the cleaning member to thereby control the potential gradient between the cleaning member and the intermediate transfer member.

20 Claims, 6 Drawing Sheets

DIFFERENCE POTENTIAL PREVENTING IMAGE FORMING APPARATUS

FIELD OF THE INVENTION AND RELATED ART STATEMENT

The present invention relates to an electrophotographic image forming apparatus, such as a copying machine, a printer, a facsimile, or a multifunction apparatus formed by combining them, and in particular, to an improvement in a cleaning technique for an image forming apparatus.

Up to now, electrophotographic (electrostatic transfer type) image forming apparatuses, such as copying machines and printers, have been widely known. In such image forming apparatuses, a toner image is transferred to a recording sheet by a final transfer member, and then the toner image is fixed to thereby realize on the recording sheet the toner image as a permanent image. The portion of the toner remaining on the transfer member without being transferred to the recording sheet has to be removed by a cleaning device in the image forming apparatus. As a method for removing such residual toner, there has been proposed a technique according to which a metal cleaning roll is caused to abut the transfer member, thereby making the residual toner to adhere to the cleaning roll by electrostatic force (See, for example, JP 6-59586 A and JP 6-35340 A). Further, there has also been proposed a technique according to which a metal cleaning blade is caused to abut against a metal cleaning roll to prevent the cleaning blade from being turned up (See, for example, JP 2000-142310).

However, these conventional techniques have the following problem.

The metal cleaning roll exhibits a relatively low electrical resistance value, so that the surface potential thereof is quickly changed in response to a variation in the bias to be applied thereto. Whereas, an intermediate transfer member which is in contact with the cleaning roll exhibits a relatively high electrical resistance value, so that even if the bias to be applied varies, the surface potential thereof is only changed transitionally. Thus, an excessive difference in potential can be instantaneously generated between the cleaning roll and the intermediate transfer member. As a result, a discharge stress is imparted to the intermediate transfer member, thereby deteriorating or damaging the surface of the intermediate transfer member.

OBJECT AND SUMMARY OF THE INVENTION

The present invention has been made in view of the above-mentioned technical problem, and provides an image forming apparatus capable of preventing generation of an excessive difference in potential between a cleaning member and an intermediate transfer member, thereby making it possible to elongate the service life of the intermediate transfer member.

According to an aspect of the present invention, an image forming apparatus includes: an image bearing member; an image forming unit which forms a toner image on the surface of the image bearing member; an intermediate transfer device formed by at least one intermediate transfer member, and which is in contact with the image bearing member; a final transfer member which is in contact with the intermediate transfer member; a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to thereby control a potential gradient between the cleaning member and the intermediate transfer member, in which when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively (substantially at the same time), the control unit makes the switching start timing for the intermediate-transfer-member-bias earlier than the switching start timing for the cleaning-member-bias.

More specifically, the control unit can be constructed such that during the transition of the intermediate-transfer-member-bias from the first intermediate-transfer-member-bias to the second intermediate-transfer-member-bias, the switching of the cleaning-member-bias is started. Further, the control unit can also be constructed such that after the transition of the intermediate-transfer-member-bias to the second intermediate-transfer-member-bias, the switching of the cleaning-member-bias is started.

According to another aspect of the present invention, the image forming apparatus includes: an image bearing member; an image forming unit which forms a toner image on the surface of the image bearing member; an intermediate transfer device formed by at least one intermediate transfer member, and which is in contact with the image bearing member; a final transfer member which is in contact with the intermediate transfer member; a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to thereby control the potential gradient between the cleaning member and the intermediate transfer member, in which when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively (substantially at the same time), the control unit effects the switching of the cleaning-member-bias stepwise.

More specifically, the stepwise switching of the cleaning-member-bias may be effected in two stages; it is possible to effect switching from a first cleaning-member-bias to a transition cleaning-member-bias and then effect switching from an intermediate cleaning-member-bias to a second cleaning-member-bias. The stepwise switching of the cleaning-member-bias may be effected in three stages; it is possible to effect switching from a first cleaning-member-bias to a first transition cleaning-member-bias and then effect switching from the first transition cleaning-member-bias to a second transition cleaning-member-bias and then effect switching from the second transition cleaning-member-bias to a second cleaning-member-bias.

Further, it is possible to set the transition cleaning-member-biases (the first transition cleaning-member-bias and the second transition cleaning-member-bias) to be smaller than the second intermediate-transfer-member-bias.

Further, the stepwise switching of the cleaning-member-bias is effected such that the variation in the cleaning-member-bias increases gradually. For example, it is possible to effect setting such that the following inequality holds good: |(transition cleaning-member-bias)−(first cleaning-member-bias)|<|(second cleaning-member-bias)−(transition cleaning-member-bias)|, and that the following inequality holds good: |(first transition cleaning-member-bias)−(first cleaning-member-bias)|<|(second transition cleaning-member-bias)−(first transition cleaning-member-bias)|<|(second cleaning-member-bias)−(second transition cleaning-member-bias)|.

Further, it is also possible to combine the first and second aspects of the invention. That is, according to another aspect of the present invention, the image forming apparatus includes: an image bearing member; an image forming unit which forms a toner image on the surface of the image bearing member; an intermediate transfer device formed by at least one intermediate transfer member, and which is in contact with the image bearing member; a final transfer member which is in contact with the intermediate transfer member; a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to thereby control the potential gradient between the cleaning member and the intermediate transfer member, in which when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively (substantially at the same time), the control unit makes the switching start timing for the intermediate-transfer-member-bias earlier than the switching start timing for the cleaning-member-bias, and effects switching of the cleaning-member-bias stepwise.

Examples of the situation in which switching of the intermediate-transfer-member-bias to be applied to the intermediate transfer member from the first intermediate-transfer-member-bias to the second intermediate-transfer-member-bias and switching of the cleaning-member-bias to be applied to the cleaning member from the first cleaning-member-bias to the second cleaning-member-bias are effected respectively (substantially at the same time) include the time when power is turned on, transition from a standby mode to an image formation mode, transition from the image formation mode to a cleaning mode, transition from the cleaning mode to the image formation mode, transition from the cleaning mode to the standby mode, and transition from a normal-polarity cleaning mode to a reversed-polarity cleaning mode.

Further, the second intermediate-transfer-member-bias and the second cleaning-member-bias are of the same polarity, and when the following inequality: |(second intermediate-transfer-member-bias)|<|(second cleaning-member-bias)| holds good, in general, discharge is likely to occur between the cleaning member and the intermediate transfer member, so that application of the present invention to such a case is particularly effective.

Further, taking into account the fact that discharge between the cleaning member and the intermediate transfer member is likely to occur when the potential of the cleaning member is higher than the potential of the intermediate transfer member, it is desirable to perform control such that during switching from the first intermediate-transfer-member-bias to the second intermediate-transfer-member-bias, the relationships: −Δ(lower limit) (0<Δ(lower limit))<(cleaning-member-bias)−(intermediate-transfer-member-bias) <Δ(upper limit) (0<Δ(upper limit)), and Δ(upper limit) <Δ(lower limit) are satisfied. Further, it is desirable to perform control such that during switching from the first intermediate-transfer-member-bias to the second intermediate-transfer-member-bias, the relationship: (cleaning-member-bias)<(intermediate-transfer-member-bias) is satisfied.

Further, generally speaking, when the electrical resistance of the cleaning member is lower than the electrical resistance of the intermediate transfer member which is in contact with the cleaning member, discharge is likely to occur between the cleaning member and the intermediate transfer member, so that application of the present invention to such a case is particularly effective. Specifically, as the cleaning member, it is possible to adopt a metal cleaning roll. In this case, an arrangement may be adopted in which a metal cleaning blade is caused to abut against the cleaning roll.

Further, the present invention is applicable not only to a monochrome image forming apparatus, but also to a multicolor image forming apparatus. That is, it is possible to adopt a construction which has, as the image bearing member, plural image bearing members for different colors and, as the intermediate transfer device, a single intermediate transfer member. Further, it is also possible to adopt a construction which has, as the image bearing member, plural image bearing members for different colors and, as the intermediate transfer device, a first upstream side intermediate transfer member which is in contact with a part of the plural image bearing members, a first downstream side intermediate transfer member which is in contact with a part of the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member.

More specifically, the latter type of image forming apparatus may have, as the image bearing member, four image bearing members for yellow, magenta, cyan, and black, and may have, as the transfer device, a first upstream side intermediate transfer member and a first downstream side intermediate transfer member which are respectively in contact with two of the four image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member.

In accordance with the present invention, it is possible to provide an image forming apparatus capable of preventing generation of an excessive difference in potential between the cleaning member and the intermediate transfer member and of extending the service life of the intermediate transfer member.

BRIEF DESCRIPTION OF THE DRAWINGS

Preferred embodiments of the present invention will be described in detail based on the following figures, wherein.

DETAILED DESCRIPTION OF THE PREFERRED EMBODIMENT

Preferred embodiments of the present invention will now be described in detail.

Figure 1:
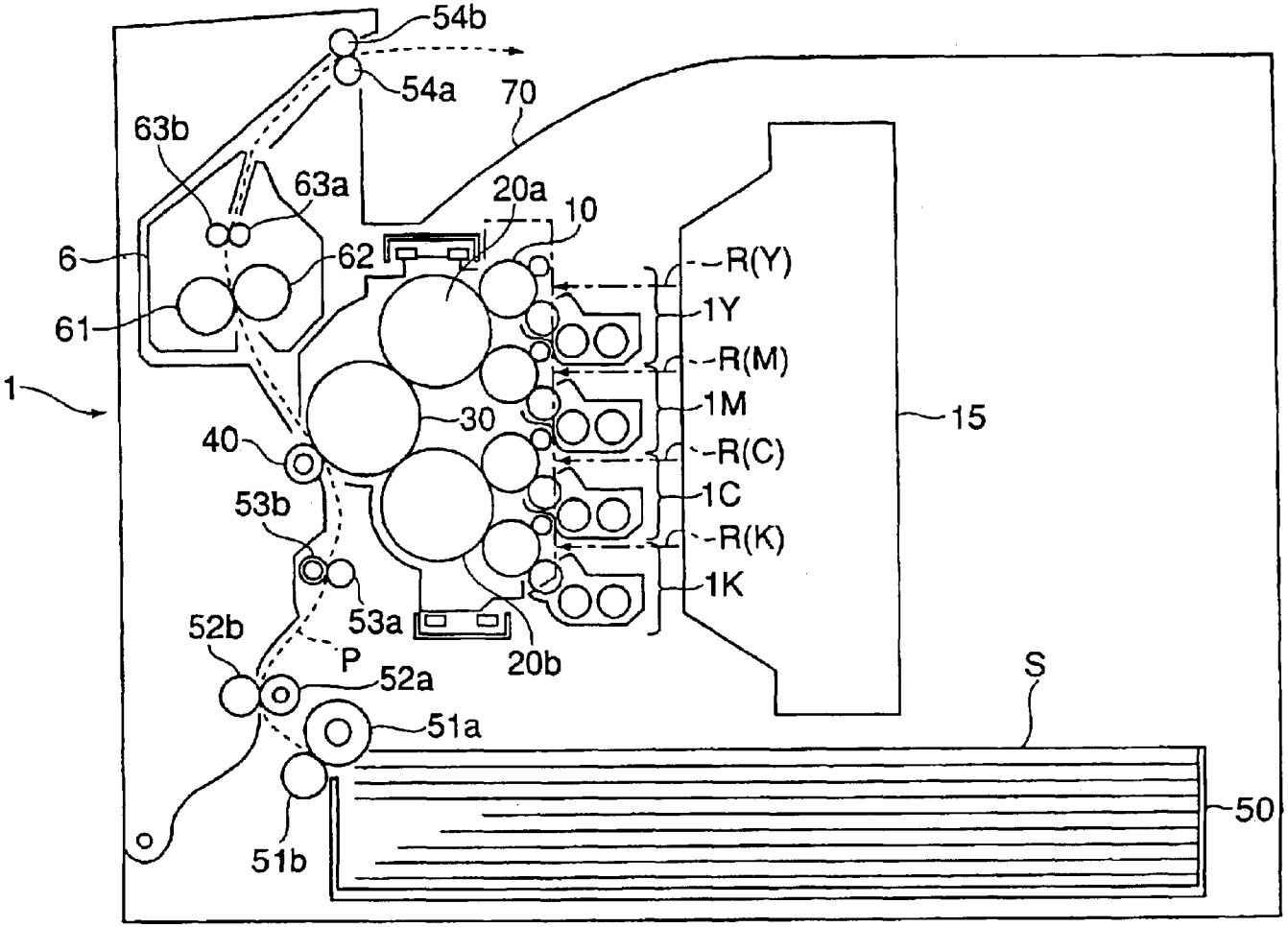
FIG. 1 is a schematic sectional view of a full color printer according to an embodiment of the present invention.
Figure 2:
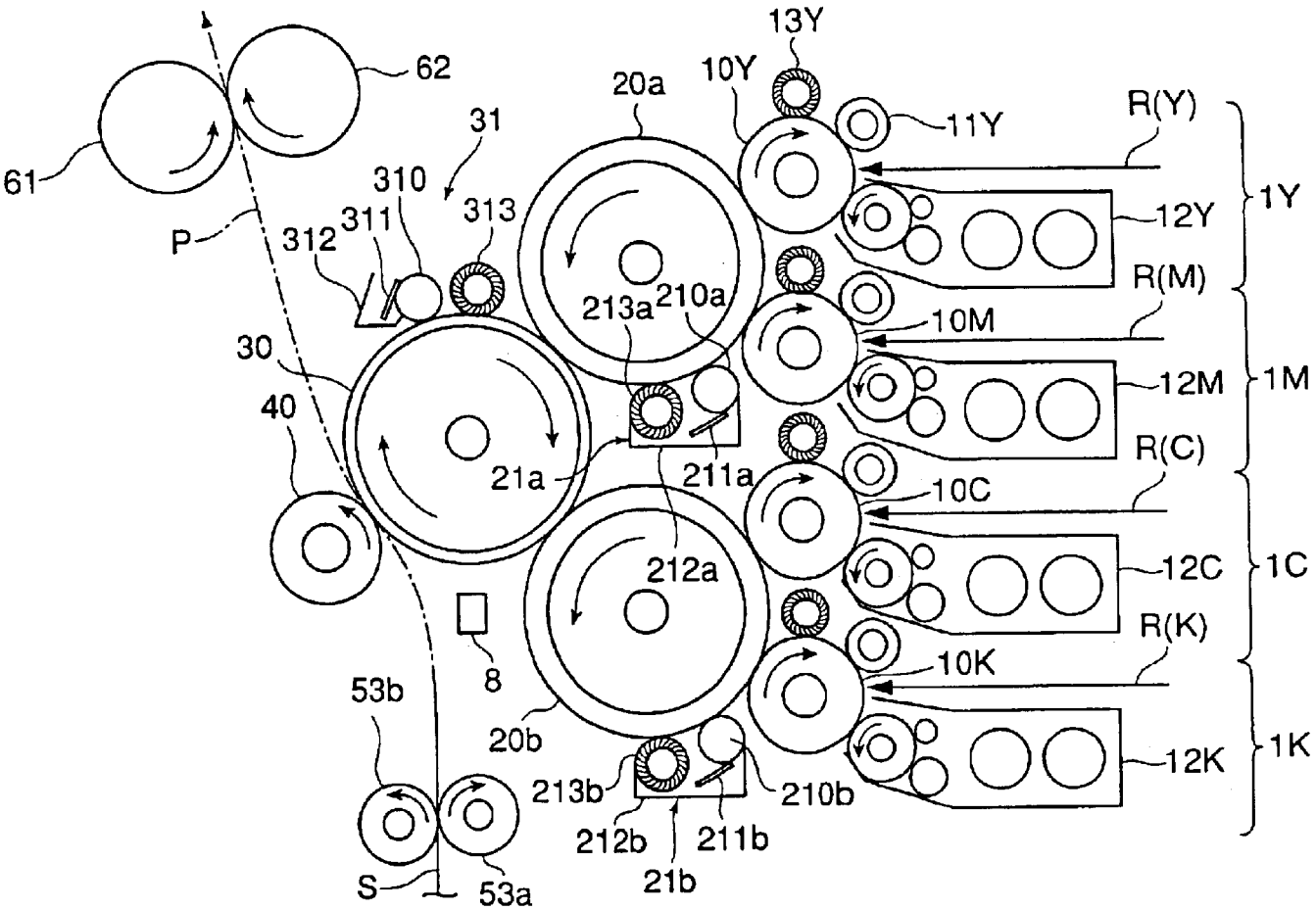
FIG. 2 is a main-part sectional view of a full color printer according to an embodiment of the present invention.

FIG. 1 shows a tandem type full color printer (image forming apparatus) according to an embodiment of the present invention. FIG. 2 is shows a main image forming portion of the full color printer (image forming apparatus) shown in FIG. 1.

This full color printer 1 is roughly composed of an image forming portion, an intermediate transfer device, a final transfer roll 40, a fixing device 6, and a sheet feeding portion.

The image forming portion is composed of four image forming units 1Y through 1K for yellow R(Y) or(Y), magenta R(M) or (M), cyan R(C) or (C), and black R(K) or (K), and an exposure. The image forming units 1Y through 1K are respectively composed of four photosensitive drums (image bearing members) 10Y through 10K, charging rolls (contact type charging members) 11Y which are respectively in contact with the photosensitive drums 10Y through 10K, developing devices 12Y through 12K respectively opposed to the photosensitive drums 10Y through 10K, and brush rolls, e.g., 13Y which are respectively in contact with the photosensitive drums 10Y through 10K.

Regarding the arrangement of the members around each photosensitive drum 10, the charging roll 11, the developing device 12 (the developing sleeve of the developing device), a first intermediate transfer roll (described below), and the brush roll, e.g., 13Y are arranged around the photosensitive drum 10 from the upstream side to the downstream side with respect to the rotating direction of the photosensitive drum 10.

A DC voltage of approximately −840 V is applied to the photosensitive drums 10Y through 10K by the charging rolls 11Y through 11K, whereby the drums are uniformly charged to approximately 300 V; when electrostatic latent images are written thereto by the exposure devices 15, the surface potential thereof is reduced to approximately −60 V.

Each of the developing devices 12Y through 12K is a magnetic-brush-contact, two-component development type developing device equipped with a developing roll, a developer amount regulating member, a developer carrying member, and an auger for carrying and agitating developer. The amount of developer regulated by the developer amount regulating member and carried to the developing portion is approximately 30 to 40 g/m$^2$; at this time, the charge amount of the toner existing on the developing roll is approximately −20 to −30 $\mu$C/g. An AC+DC developing voltage is applied to these developing devices 12Y through 12K to execute development; this developing voltage is composed of an AC component of approximately 4 kHz and 1.6 kVpp, and a DC component of approximately −230 V.

The intermediate transfer device is equipped with a first upstream side intermediate transfer roll (first upstream side intermediate transfer member) 20*a* which is in contact with the photosensitive drums 10Y and 10M, a first downstream side intermediate transfer roll (first downstream side intermediate transfer member) 20*b* which is in contact with the photosensitive drums 10C and 10K, a second intermediate transfer roll 30 which is in contact with the two first intermediate transfer rolls 20*a* and 20*b*, and a toner sensor 8 which detects optically and in a non-contact fashion the presence and density of a toner image on the second intermediate transfer roll 30.

Further, the first upstream side intermediate transfer roll 20*a* is equipped with a first upstream side cleaning device (cleaning device) 21*a*. This first upstream side cleaning device 21*a* is equipped with a metal (stainless steel) cleaning roll (cleaning member) 210*a* which is in contact with the first upstream side intermediate transfer roll 20*a*, a cleaning blade 211*a* abutting the cleaning roll 210*a*, an intermediate transfer brush roll 213*a* which is in contact with the intermediate transfer roll 20*a* in the vicinity of the upstream side of the cleaning roll 210*a* with respect to the rotating direction of the first upstream side intermediate transfer roll 20*a*, and a cleaner housing 212*a* which accommodates the cleaning roll 210*a*, the cleaning blade 211*a*, and the intermediate transfer brush roll 213*a*.

Similarly, the first downstream side intermediate transfer roll 20*b* is equipped with a first downstream side cleaning device (cleaning device) 21*b*. This first downstream side cleaning device 21*b* is equipped with a metal (stainless steel) cleaning roll (cleaning member) 210*b* which is in contact with the first downstream side intermediate transfer roll 20*b*, a cleaning blade 211*b* abutting the cleaning roll 210*b*, an intermediate transfer brush roll 213*b* which is in contact with the intermediate transfer roll 20*b* in the vicinity of the upstream side of the cleaning roll 210*b* with respect to the rotating direction of the first downstream side intermediate transfer roll 20*b*, and a cleaner housing 212*b* which accommodates the cleaning roll 210*b*, the cleaning blade 211*b*, and the intermediate transfer brush roll 213*b*.

The second intermediate transfer roll 30 is equipped with a second cleaning device (cleaning device) 31. This second cleaning device 31 is equipped with a metal (stainless steel) cleaning roll (cleaning member) 310 which is in contact with the second intermediate transfer roll 30, a cleaning blade 311 abutting the cleaning roll 310, a brush roll 313 which is in contact with the intermediate transfer roll 30 in the vicinity of the downstream side of the cleaning roll 310 with respect to the rotating direction of the second intermediate transfer roll 30, and a cleaner housing (accommodating member) 312 accommodating the cleaning roll 310, the cleaning blade 311, and the brush roll 313.

Regarding the arrangement of the members around the first upstream side intermediate transfer roll 20*a*, the photosensitive drum 10M, the photosensitive drum 10Y, the second intermediate transfer roll 30, the intermediate transfer brush roll 213*a*, and the cleaning roll 210*a* are arranged around the first upstream side intermediate transfer roll 20*a* from the upstream side to the downstream side with respect to the rotating direction of the first upstream side intermediate transfer roll 20*a*. Further, regarding the arrangement of the members around the first downstream side intermediate transfer roll 20*b*, the photosensitive drum 10K, the photosensitive drum 10C, the second intermediate transfer roll 30, the intermediate transfer brush roll 213*b*, and the cleaning roll 210*b* are arranged around the first downstream side intermediate transfer roll 20*b* from the upstream side to the downstream side with respect to the rotating direction of the first downstream side intermediate transfer roll 20*b*. Further, regarding the arrangement of the members around the second intermediate transfer roll 30, the first upstream side intermediate transfer roll 20*a*, the first downstream side intermediate transfer roll 20*b*, the toner sensor 8, the final transfer roll 40, the cleaning roll 310, and the brush roll 313 are arranged around the second intermediate transfer roll 30 from the upstream side to the downstream side with respect to the rotating direction of the second intermediate transfer roll 30.

Each of the first intermediate transfer rolls 20*a* and 20*b* is formed by providing a silicone rubber layer on a metal pipe, and forming thereon a high release coating layer; while the acceptable resistance value thereof normally ranges from $10^5$ to $10^9$ Ω, in this example, it is approximately $10^8$ Ω. This electrical resistance value is higher than that of the cleaning rolls 210*a*, 210*b*, and 310. And, the requisite surface potential for transferring toner images from the photosensitive drums 10Y through 10K to the first intermediate transfer rolls 20*a* and 20*b* normally ranges from approximately +250 through 500 V, and an optimum potential value can be set according to the toner charging condition, the ambient temperature, the humidity, etc.

Like the first intermediate transfer rolls 20*a* and 20*b*, the second intermediate transfer roll 30 is formed by providing a silicone rubber layer on a metal pipe and forming thereon a high release coating layer; while the acceptable resistance value thereof normally ranges from $10^8$ to $10^{12}$ Ω, in this example, it is approximately $10^{11}$ Ω (That is, it exhibits a resistance value higher than that of the first intermediate transfer rolls 20*a* and 20*b*). And, the requisite surface potential for transferring toner images from the first intermediate transfer rolls 20*a* and 20*b* to the second intermediate transfer roll 30 normally ranges from approximately +600 through 1200 V, and an optimum potential value can be set according to the toner charging condition, the ambient temperature, the humidity, etc.

The final transfer roll 40 is formed by providing an urethane rubber layer on a metal pipe and providing thereon a resin coating layer; while the acceptable resistance value thereof normally ranges from $10^6$ to $10^9$ Ω, in this example, it is approximately $10^8$ Ω (That is, it exhibits a resistance value lower than that of the second intermediate transfer roll 30). And, the transfer voltage to be applied to this final transfer roll 40 in order to transfer a toner image from the second intermediate transfer roll 30 to the sheet (recording sheet) normally ranges from approximately +1200 through 5000 V, and an optimum voltage value can be set according to the ambient temperature, the humidity, the kind of sheet S (the resistance value thereof, etc.), etc. In this example, the constant current system is adopted, and approximately +6 μA is applied under normal temperature and normal humidity to obtain a substantially appropriate final transfer voltage of approximately +1600 to 2000 V.

Further, (unlike the first intermediate transfer rolls 20*a* and 20*b* and the second intermediate transfer roll 30), the final transfer roll 40 is not caused to abut against the cleaning roll (cleaning member). Further, (exclusive of the time when replacing the image forming unit and inclusive of the times when the apparatus is in the image formation mode, the process control mode, and the cleaning mode), the final transfer roll 40 comes into contact with the second intermediate transfer roll 30, and requires no special retracting mechanism or the like.

The surface roughness (Rz) of the final transfer roll 40 may be 20 [μm(Rz)] or less, for example, 10 [μm(Rz)], and the surface roughness (Rz) of the first and second intermediate transfer rolls 20*a*, 20*b*, and 30 may be 10 [μm(Rz)] or less, for example, 1 [μm(Rz)]. Further, the final transfer roll 40 exhibits a higher degree of surface roughness (Rz) than the first and second intermediate transfer rolls 20*a*, 20*b*, and 30. It is desirable that the surface roughness of these rolls be not more than the average grain size of the toner forming the toner image.

In the fixing device 6, a heating roll 62 and a pressurizing roll 61 are held in press contact with each other to form a fixing nip. Arranged in the heating roll 62 is a halogen lamp (not shown) serving as the heat source; at the time of fixing, the surface of the heating roll 62 is heated to a predetermined fixing temperature. Further, on the downstream side of the fixing nip with respect to the direction in which the sheet S is transported, there are arranged fixing/discharge roll pairs 63*a* and 63*b*.

The sheet feeding portion is formed along the transport path (indicated by the dotted line) P for the sheet S extending from the sheet feeding tray 50 to the discharge tray 70. The sheet feeding tray 50 accommodates plural sheets S, and from the sheet feeding tray 50 to the downstream side of the transport path, there are sequentially arranged a roll pair formed by a pick-up roll 51*a* and a retarding roll 51*b*, a pair of transport rolls 52*a* and 52*b*, a pair of registration rolls 53*a* and 53*b*, and (on the downstream side of the final transfer roll 40 and the fixing device 6) a pair of discharge rolls 54*a* and 54*b*.

Figure 3:
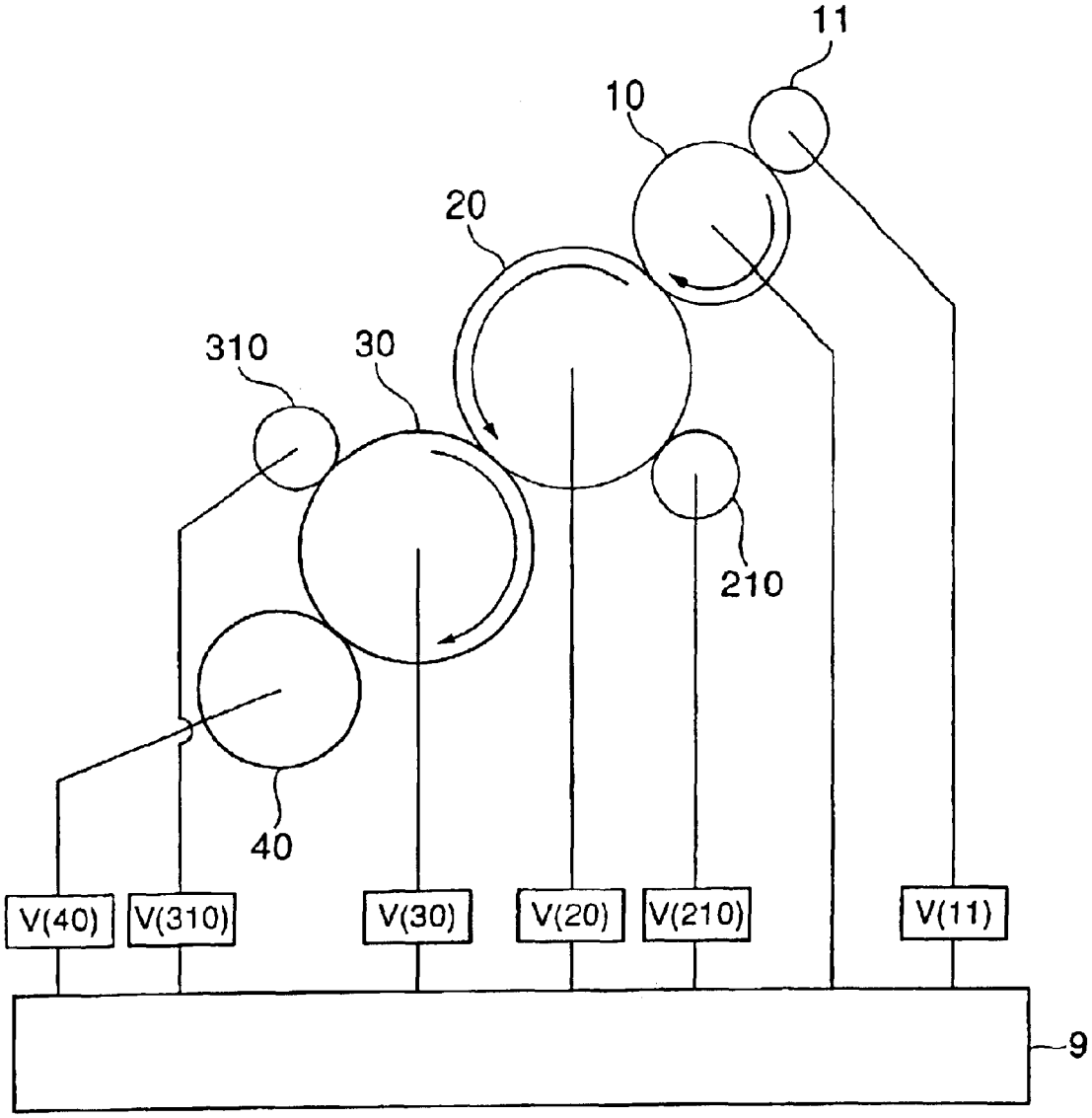
FIG. 3 is a block diagram illustrating the construction of a potential gradient control system of a full color printer according to an embodiment of the present invention.

FIG. 3 is a block diagram illustrating the potential control system of this full color printer 1. According to the situation the color printer 1 is in, that is, based on the fact as to whether the printer is ready for the printing sequence (the image formation mode) or the cleaning sequence (the cleaning mode), the potential control portion (control unit) 9 controls voltages V(11), V(20), V(21*a*), V(30), V(310), and V(40) respectively applied to the charging roll 11, the first intermediate transfer rolls 20*a* and 20*b*, the cleaning roll 210, (voltage V(21(*a*)), the second intermediate transfer roll 30, the cleaning roll 310, and the final transfer roll 40, with the result that according to the situation the full color printer 1 is in, an appropriate potential gradient is formed between the charging roll 11, the first intermediate transfer rolls 20*a* and 20*b*, the cleaning roll 210, the second intermediate transfer roll 30, the cleaning roll 310, and the final transfer roll 40.

Figure 4:
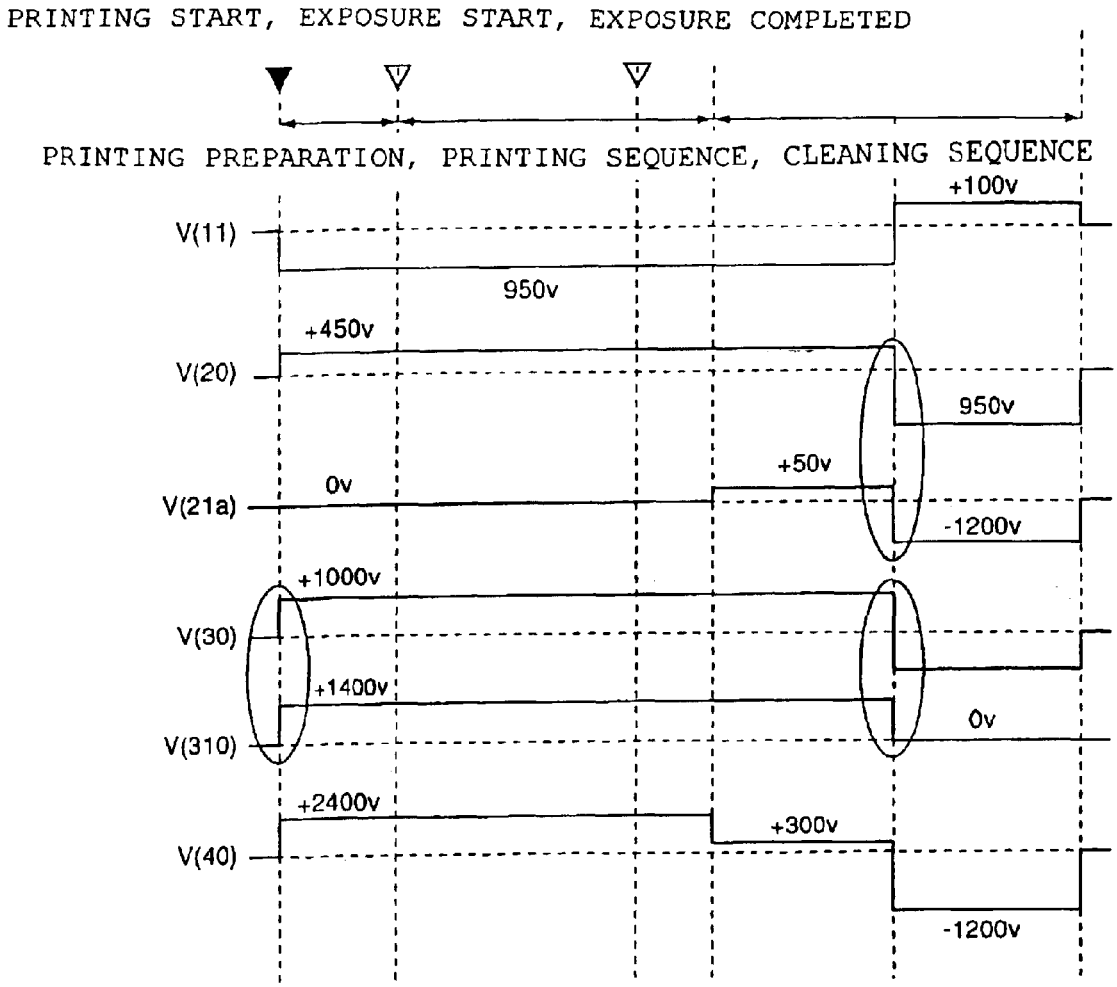
FIG. 4 is a timing chart illustrating the operation of a potential gradient control system of a full color printer according to an embodiment of the present invention.

FIG. 4 is a timing chart showing the values of the voltages applied to the charging roll 11, the first intermediate transfer rolls 20*a* and 20*b*, the cleaning roll 210, the second intermediate transfer roll 30, the cleaning roll 310, and the final transfer roll 40 in the printing preparation sequence, the printing sequence, and the cleaning sequence. As can be clearly seen from this timing chart, the portions of the timing chart encircled by ellipsoids indicate the points in time at which the biases applied to the intermediate transfer rolls 20*a*, 20*b*, and 30 and the biases applied to the cleaning rolls 210 and 310 are simultaneously switched, that is, during the transition from the standby state to the printing sequence and the transition from the normal polarity cleaning to the reverse polarity cleaning in the cleaning sequence.

During the transition from the standby state to the printing preparation sequence, the bias (the intermediate-transfer-member-bias) applied to the second intermediate transfer roll 30 is switched from V1(30)=0 [V] (the first intermediate-transfer-member-bias) to V2(30)=+1000 [V] (the second intermediate-transfer-member-bias). During the transition from the standby state to the printing preparation sequence, the bias to be applied to the cleaning roll 310 (the intermediate-transfer-member-bias) is switched from V1(310)=0 [V] (the first cleaning-member-bias) to V2(310)=+1400 [V] (the second cleaning-member-bias). Here, V2(30) and V2(310) are of the same polarity (positive), and the relationship:

|V2(30)|<|V2(310)|holds true.

In the following, different operation modes for the bias switching control at the transition from the standby state to the printing preparation sequence according to embodiments of the present invention will be described.

Figure 5:
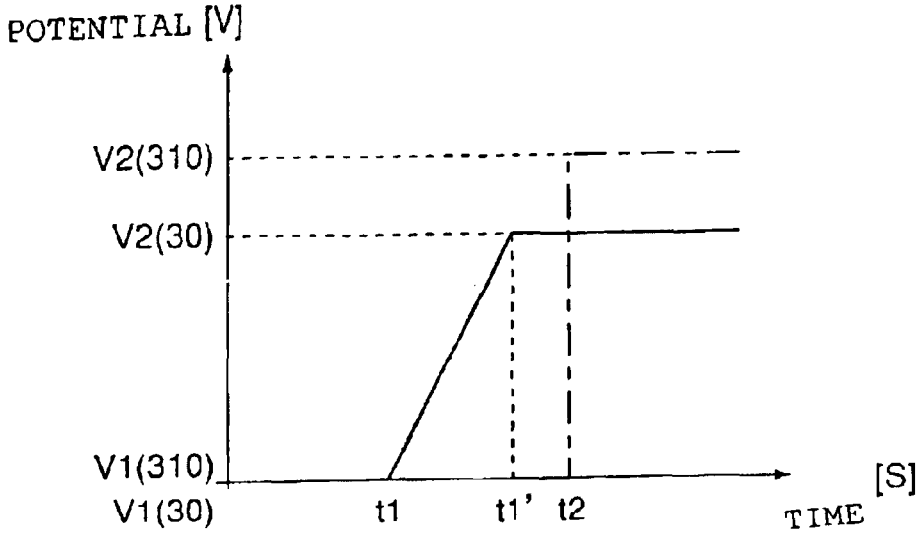
FIG. 5 is a graph illustrating the bias switching operation of a full color printer according to Embodiment 1.

Embodiment 1 FIG. 5 is a graph illustrating the potential gradient control operation for the full color printer 1 of this embodiment. In the graph, the horizontal axis indicates time [sec], and the vertical axis indicates potential [V]. The solid line indicates the variation with time of the surface potential of the second intermediate transfer roll 30, and the alternate long-and-short dashed line indicate the variation with time of the surface potential of the cleaning roll 310. Here, when the bias to be applied to the second intermediate transfer roll 30 is switched at the time point t1 from V1(30)=0 [V] to V2(30)=+1000 [V], the surface potential of the second intermediate transfer roll 30 increases transiently, and attains V2(30) at the time point t1'. When, at the time point t2, the bias to be applied to the cleaning roll 310 is switched from V1(310)=0 [V] to V2(310)=+1400 [V], the surface potential of the cleaning roll 310 immediately attains V2(310).

In this embodiment, the potential control portion 9 controls the bias switching timing such that the time point t2 is after the time point t1'. By thus controlling the bias switching timing, no great difference in potential is generated (instantaneously) between the second intermediate transfer roll 30 and the cleaning roll 310, making it possible to extend the life (service life) of the second intermediate transfer roll 30. In particular, between the time point t1 and the time point t1', the surface potential of the second intermediate transfer roll 30 is always higher than that of the cleaning roll 310, so that the discharge preventing effect is enhanced.

Embodiment 2

Figure 6:
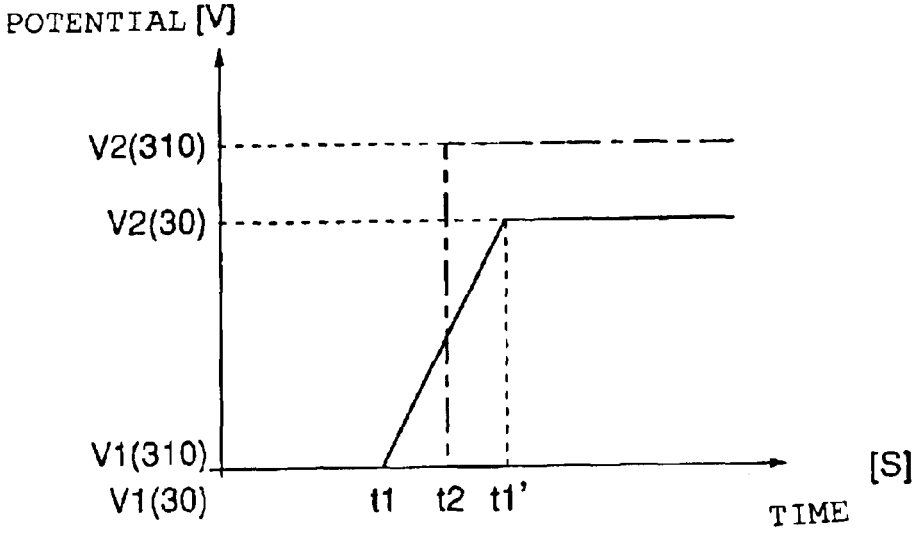
FIG. 6 is a graph illustrating the bias switching operation of a full color printer according to Embodiment 2.

FIG. 6 is a graph illustrating a potential gradient control operation for the full color printer 1 according to this embodiment. The items that are the same as those of Embodiment 1 are indicated by the same reference numerals, and a description thereof will be omitted.

In this embodiment, the bias switching timing is controlled such that the time point t2 is after the time point t1 and before the time point t1'. By thus controlling the bias switching timing, no great difference in potential is (instantaneously) generated between the second intermediate transfer roll 30 and the cleaning roll 310, making it possible to extend the life (service life) of the second intermediate transfer roll 30.

Embodiment 3

Figure 7:
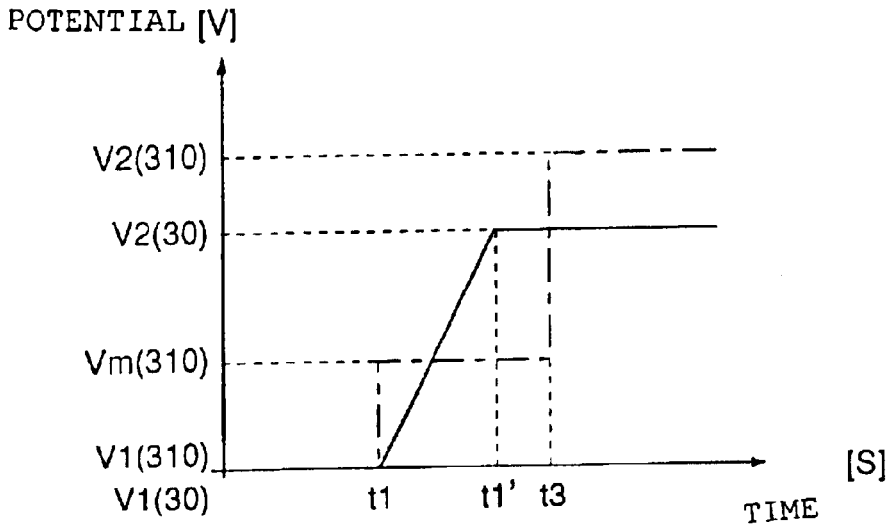
FIG. 7 is a graph illustrating the bias switching operation of a full color printer according to Embodiment 3.

FIG. 7 is a graph illustrating a potential gradient control operation for the full color printer 1 according to this embodiment. In this embodiment, when at the time point t1 the bias to be applied to the cleaning roll 310 is switched from V1(310)=0 [V] to Vm(310)=+400 [V] (V1(310)<Vm(310)<V2(310)), the surface potential of the cleaning roll 310 immediately attains Vm (310). Further, when at the time point t3 the bias to be applied to the cleaning roll 310 is switched from Vm(310) [V] to V2(310)=+1400 [V], the surface potential of the cleaning roll 310 immediately attains V2(310). Here, the relationship: |Vm(310)−V1(310)|<|V2(310)−Vm(310)| holds true. The items that are the same as those of Embodiment 1 are indicated by the same reference numerals, and a description thereof will be omitted.

In this embodiment, the potential control portion 9 controls the bias switching timing such that the time point t3 is after the time point t1'. By thus controlling the bias switching timing, no great difference in potential is (instantaneously) generated between the second intermediate transfer roll 30 and the cleaning roll 310, making it possible to extend the life (service life) of the second intermediate transfer roll 30.

Embodiment 4

Figure 8:
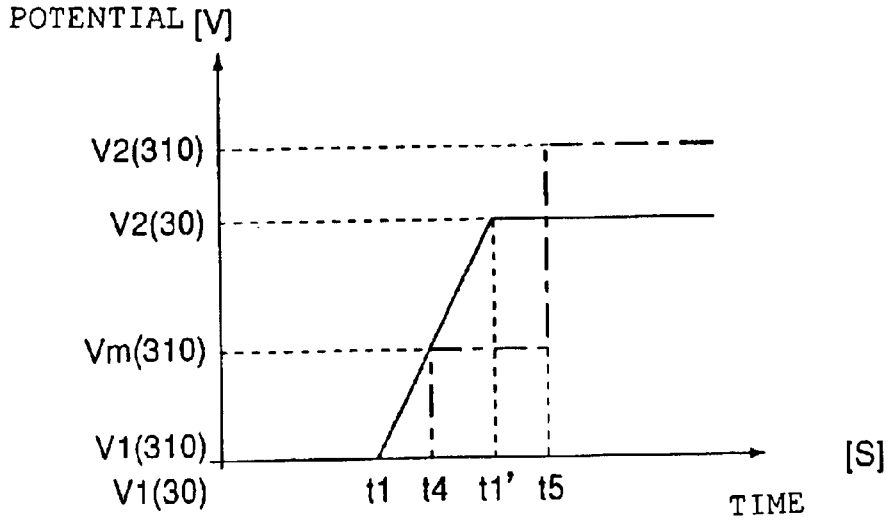
FIG. 8 is a graph illustrating the bias switching operation of a full color printer according to Embodiment 4.

FIG. 8 is a graph illustrating a potential gradient control operation for the full color printer 1 according to this embodiment. In this embodiment, when at the time point t4 the bias to be applied to the cleaning roll 310 is switched from V1(310)=0 [V] to Vm(310), the surface potential of the cleaning roll 310 immediately attains Vm(310). Further, when at the time point t5 the bias to be applied to the cleaning roll 310 is switched from Vm(310) [V] to V2(310), the surface potential of the cleaning roll 310 immediately attains V2(310). The items that are the same as those of Embodiments 1 and 3 are indicated by the same reference numerals, and a description thereof will be omitted.

In this embodiment, the potential control portion 9 controls the bias switching timing such that the time point t4 is after the time point t1 and before the time point t1'. Further, the potential control portion 9 controls the bias switching timing such that the time point t5 is after the time point t1'. By thus controlling the bias switching timing, no great difference in potential is (instantaneously) generated between the second intermediate transfer roll 30 and the cleaning roll 310, making it possible to extend the life (service life) of the second intermediate transfer roll 30. In particular, between the time point t1 and the time point t1', the surface potential of the second intermediate transfer roll 30 is always higher than that of the cleaning roll 310, so that the discharge preventing effect is enhanced.

While in Embodiments 1 through 4, described above, the bias switching timing at the time of transition from the standby state to printing sequence is controlled, the bias switching timing at the time of transition from the normal polarity cleaning to the reversed polarity cleaning during the cleaning sequence can also be controlled in the same manner. Further, while in Embodiments 1 through 4, described above, the present invention is applied to the bias switching control for the second intermediate transfer roll 30 and the cleaning roll 310 in contact therewith, it is naturally also possible to apply the present invention to the bias switching control for the first intermediate transfer rolls 20*a* and 20*b* and the cleaning rolls 210*a* and 210*b* in contact therewith.

What is claimed is:

1. An image forming apparatus comprising:

an image bearing member;

an image forming unit that forms a toner image on a surface of the image bearing member;

an intermediate transfer device formed by at least one intermediate transfer member, and which is in contact with the image bearing member;

a final transfer member which is in contact with the intermediate transfer member;

a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to control a potential gradient between the cleaning member and the intermediate transfer member, wherein when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively, a surface potential of the intermediate transfer member is changed transitionally, the control unit makes a switching start timing for the intermediate-transfer-member-bias earlier than a switching start timing for the cleaning-member-bias.

2. An image forming apparatus according to claim 1, wherein the control unit makes the switching start timing for the cleaning-member-bias before a completion of the transitional change of the surface potential of the intermediate transfer member.

3. An image forming apparatus according to claim 1, wherein the control unit makes the switching start timing for the cleaning-member-bias after a completion of the transitional change of the surface potential of the intermediate transfer member.

4. An image forming apparatus according to claim 1, wherein the second intermediate-transfer-member-bias and the second cleaning-member-bias are of the same polarity, and a relationship: |(second intermediate-transfer-member-bias)|<|(second cleaning-member-bias)|is satisfied.

5. An image forming apparatus according to claim 1, wherein during switching from the first intermediate-transfer-member-bias to the second intermediate transfer-member-bias, a relationship: (cleaning-member-bias)<(the surface potential of the intermediate transfer member) is satisfied.

6. An image forming apparatus according to claim 1, wherein an electrical resistance of the cleaning member is lower than an electrical resistance of the intermediate transfer member which is in contact with the cleaning member.

7. An image forming apparatus according to claim 1, wherein the cleaning member is a metal cleaning roll.

8. An image forming apparatus comprising:

an image bearing member;

an image forming unit that forms a toner image on a surface of the image bearing member;

an intermediate transfer device formed by at least one intermediate transfer member, and which is in contact with the image bearing member;

a final transfer member which is in contact with the intermediate transfer member;

a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to control a potential gradient between the cleaning member and the intermediate transfer member, wherein when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively, the control unit makes a switching start timing for the intermediate-transfer-member-bias earlier than a switching start timing for the cleaning-member-bias, the cleaning member is a metal cleaning roll and a metal cleaning blade is caused to abut against the cleaning roll.

9. An image forming apparatus comprising:

an image bearing member;

an image forming unit which forms a toner image on a surface of the image bearing member;

an intermediate transfer device formed by at least one intermediate transfer member, and which is in contact with the image bearing member;

a final transfer member which is in contact with the intermediate transfer member;

a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to control a potential gradient between the cleaning member and the intermediate transfer member, wherein when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively, the control unit effects the switching of the cleaning-member-bias stepwise in at least two steps.

10. An image forming apparatus according to claim 9, wherein the control unit makes a switching start timing for the intermediate-transfer-member-bias before a switching start timing for the cleaning-member-bias.

11. An image forming apparatus according to claim 9, wherein the control unit makes a switching start timing for the intermediate-transfer-member-bias at the same timing with a switching start timing for the cleaning-member-bias.

12. An image forming apparatus according to claim 9, wherein when switching the cleaning-member-bias to be applied to the cleaning member from the first cleaning-member-bias to the second cleaning-member-bias, the control unit effects a first switching from the first cleaning-member-bias to an intermediate cleaning-member-bias and then effects a second switching from the intermediate cleaning-member-bias to the second cleaning-member-bias.

13. An image forming apparatus according to claim 12, wherein a relationship: |(intermediate-cleaning-member-bias)|-(first cleaning-member-bias)<|(second cleaning-member-bias)|-(intermediate cleaning-member-bias)|is satisfied.

14. An image forming apparatus according to claim 12, wherein the intermediate-transfer-member-bias changes gradually, and the control unit makes the second switching start timing after a completion of a transitional change of a surface potential of the intermediate transfer member.

15. An image forming apparatus according to claim 9, wherein the control unit effects the switching of the cleaning-member-bias stepwise in three steps.

16. An image forming apparatus according to claim 9, wherein the second intermediate-transfer-member-bias and the second cleaning-member-bias are of the same polarity, and a relationship: |(second intermediate-transfer-member-bias)|<|(second cleaning-member-bias)|is satisfied.

17. An image forming apparatus according to claim 9, wherein during switching from the first intermediate-transfer-member-bias to the second intermediate transfer-member-bias, a relationship: (cleaning-member-bias)<(the surface potential of the intermediate transfer member) is satisfied.

18. An image forming apparatus according to claim 9, wherein an electrical resistance of the cleaning member is lower than an electrical resistance of the intermediate transfer member which is in contact with the cleaning member.

19. An image forming apparatus according to claim 9, wherein the cleaning member is a metal cleaning roll.

20. An image forming apparatus comprising:

an image bearing member;

an image fanning unit which forms a toner image on a surface of the image bearing member;

an intermediate transfer device formed by at least one intermediate transfer member, and which is in contact with the image bearing member;

a final transfer member which is in contact with the intermediate transfer member;

a cleaning member which is in contact with the intermediate transfer member; and a control unit which applies an intermediate-transfer-member-bias to the intermediate transfer member and applies a cleaning-member-bias to the cleaning member which is in contact with the intermediate transfer member to control a potential gradient between the cleaning member and the intermediate transfer member, wherein when switching the intermediate-transfer-member-bias to be applied to the intermediate transfer member from a first intermediate-transfer-member-bias to a second intermediate-transfer-member-bias and switching the cleaning-member-bias to be applied to the cleaning member from a first cleaning-member-bias to a second cleaning-member-bias, respectively, the control unit effects the switching of the cleaning-member-bias stepwise, the cleaning member is a metal cleaning roll and a metal clearing blade is cause to abut against the cleaning roll.

* * * * *